US009901981B2

(12) United States Patent
Kim

(10) Patent No.: US 9,901,981 B2
(45) Date of Patent: Feb. 27, 2018

(54) ALLOY PRODUCTION METHOD AND ALLOY PRODUCED BY THE SAME

(71) Applicant: KOREA INSTITUTE OF INDUSTRIAL TECHNOLOGY, Chungcheongnam-do (KR)

(72) Inventor: Shae-Kwang Kim, Seoul (KR)

(73) Assignee: KOREA INSTITUTE OF INDUSTRIAL TECHNOLOGY, Chungsheongnam-do (KR)

( * ) Notice: Subject to any disclaimer, the term of this patent is extended or adjusted under 35 U.S.C. 154(b) by 0 days.

(21) Appl. No.: 15/474,203

(22) Filed: Mar. 30, 2017

(65) Prior Publication Data

US 2017/0266721 A1 Sep. 21, 2017

Related U.S. Application Data

(62) Division of application No. 14/119,080, filed as application No. PCT/KR2012/003849 on May 16, 2012, now abandoned.

(30) Foreign Application Priority Data

May 20, 2011 (KR) ..... 10-2011-0048192

(51) Int. Cl.

| | |
|---|---|
| ***B22D 25/00*** | (2006.01) |
| ***B22D 21/04*** | (2006.01) |
| ***C22C 1/02*** | (2006.01) |
| ***C22C 1/03*** | (2006.01) |
| ***C22C 23/00*** | (2006.01) |
| ***C22C 23/02*** | (2006.01) |
| ***C22C 21/06*** | (2006.01) |

(52) U.S. Cl.
CPC ..... *B22D 25/00* (2013.01); *B22D 21/04* (2013.01); *C22C 1/02* (2013.01); *C22C 1/03* (2013.01); *C22C 21/06* (2013.01); *C22C 23/00* (2013.01); *C22C 23/02* (2013.01)

(58) Field of Classification Search
CPC ..... B22D 21/04; B22D 25/00
See application file for complete search history.

(56) References Cited

FOREIGN PATENT DOCUMENTS

| | | | |
|---|---|---|---|
| CN | 101008061 | A | 8/2007 |
| CN | 101818293 | A | 9/2010 |
| CN | 101970703 | A | 2/2011 |
| CN | 102000808 | A | 4/2011 |
| EP | 1469091 | A1 | 10/2004 |
| EP | 1777022 | A1 | 4/2007 |
| EP | 2270243 | A1 | 1/2011 |

(Continued)

OTHER PUBLICATIONS

International Search Report dated Dec. 10, 2012; PCT/KR2012/003849.

(Continued)

*Primary Examiner* — Rebecca Y Lee
(74) *Attorney, Agent, or Firm* — Ladas & Parry LLP

(57) ABSTRACT

Provided are an alloy production method that may easily distribute a compound in a matrix of an alloy while maintaining the quality of a molten metal, and an alloy produced by the same. In accordance with an exemplary embodiment, the method includes forming a molten metal in which a mother alloy including at least one kind of first compound and a casting metal are melted, and casting the molten metal, wherein the mother alloy is a magnesium mother alloy or aluminum mother alloy.

9 Claims, 8 Drawing Sheets

(56) References Cited

FOREIGN PATENT DOCUMENTS

| | | | |
|---|---|---|---|
| EP | 2309006 | A1 | 4/2011 |
| EP | 2333122 | A1 | 6/2011 |
| EP | 2677049 | A1 | 12/2013 |
| JP | 10-086724 | A | 4/1998 |
| JP | 10-195665 | A | 7/1998 |
| JP | 2003-142415 | A | 5/2003 |
| JP | 2007-107083 | A | 4/2007 |
| KR | 1020020041537 | A | 6/2002 |
| KR | 020060094734 | A | 8/2006 |
| KR | 1020060103601 | A | 10/2006 |
| KR | 10-0654134 | B1 | 11/2006 |
| KR | 2298944 | A1 | 3/2011 |

OTHER PUBLICATIONS

Korean Notice of Allowance dated Jul. 31, 2013; Appln. No. 10-2011-0120219.
Extended European Search Report dated Nov. 19, 2014; Appln. No. 12789328.7 PCT/KR2012003849.
Chinese Office Acton dated Apr. 13, 2015; Appln. No. 201280035788.9.
Fourth Chinese Office Action dated May 12, 2017; Appln. No. 201280035788.9.
USPTO RR dated Jun. 20, 2016 in connection with U.S. Appl. No. 14/119,080.
USPTO NFOA dated Sep. 1, 2016 in connection with U.S. Appl. No. 14/119,080.

ALLOY PRODUCTION METHOD AND ALLOY PRODUCED BY THE SAME

BACKGROUND

The present disclosure relates to an alloy production method and an alloy produced by the same, and more particularly, to an alloy production method in which a mother alloy is used in casting, and an alloy produced by the same.

Alloys may be produced by adding an alloy element to a liquid molten metal and performing a casting. In producing an alloy using such a casting technique, the quality of molten metal has a great influence on characteristics of the alloy. Particularly, in the case where magnesium, aluminum or the like having a high oxidation property is added as an alloy element in a molten metal, a tendency that an impurity such as inclusion is increased in the molten metal by oxidation of the alloy element is shown. Such an impurity may cause degradation of alloys in view of mechanical and chemical properties. Therefore, in order to improve properties of an alloy produced by casting, it is necessary to maintain cleanness in the molten metal as high as possible. To obtain a high quality molten metal, a method of producing the molten metal in vacuum or a method of protecting a surface of the molten metal by coating the surface of the molten metal with a protection gas.

Meanwhile, in order to improve mechanical and chemical characteristics of an alloy, various compounds may be formed on a matrix of the alloy. For example, when an intermetallic compound having a high hardness is distributed on a matrix of an alloy, the intermetallic compound functions as a structure suppressing the movement of dislocations to improve the strength of the alloy. Such a compound may be crystallized as a thermodynamically stable phase while a liquid phase metal is solidified in casting, or after being solidified, precipitated through a proper mechanical processing or heat treatment.

However, in order to produce a molten metal in vacuum, an additional apparatus for maintaining vacuum is required, and a protection gas coated on a surface of the molten metal is expensive or may cause environmental problems. Also, it is difficult to control the amount or distribution of a phase crystallized during casting, and a mechanical processing or heat treatment should be accompanied in order to form a precipitate phase.

SUMMARY

The present disclosure provides an aluminum alloy and a method of producing the same that can improve mechanical characteristics by distributing an intermetallic compound (hereinafter, magnesium-silicon compound) including magnesium and silicon in an aluminum matrix without a heat treatment. The above subject matter is only exemplary, and the scope of the present disclosure is not limited by the subject matter.

The present disclose provides an alloy production method that may easily distribute a compound in a matrix of an alloy while maintaining the quality of a molten metal, and an alloy produced by the same. The above subject matter is only exemplary, and the scope of the present disclosure is not limited by the subject matter.

In accordance with an exemplary embodiment, there is provided a method of producing an alloy. A molten metal in which a mother alloy including at least one kind of first compound and a casting metal are melted is formed. The molten metal is cast. The mother alloy may be a magnesium mother alloy or aluminum mother alloy.

The first compound may have a higher melting point than the casting metal.

The casting metal may be any one selected from the group consisting of tin, aluminum, zinc, magnesium, copper, nickel, cobalt, iron, titanium, vanadium, molybdenum, tungsten, and alloys thereof.

The first compound may be a compound formed by exhausting at least a portion of a second compound in which at least two components are bonded in a magnesium molten metal or aluminum molten metal. The first compound may be a compound in which a component supplied from the exhausted second compound and a metal component in the magnesium molten metal are bonded to each other, and the metal component may be magnesium or aluminum.

The first compound may be a compound produced by a bonding between components respectively supplied from the at least two kinds of exhausted second compounds.

The first compound may be a compound formed by melting at least a portion of any one of calcium or strontium in the magnesium molten metal or aluminum molten metal.

The first compound may be a compound added to a molten metal of the mother alloy. The first compound may be produced by a mechanical alloying.

The first compound may include a magnesium compound. The magnesium compound may include at least one selected from the group consisting of a magnesium-calcium compound, a magnesium-aluminum-calcium compound, a magnesium-strontium compound, and a magnesium-silicon compound.

The first compound may include an aluminum compound. The aluminum compound may include at least one selected from an aluminum-calcium compound, an aluminum-strontium compound, and an aluminum-cesium compound.

The first compound may include a calcium-silicon compound.

The second compound may include a calcium-based compound, a strontium-based compound, a silicon-based compound, or a rare earth metal-based compound.

The producing of the magnesium mother alloy may include: adding at least one kind of second compound in which two or more components are bonded to a magnesium molten metal; exhausting at least a portion of the second compound; and casting the magnesium molten metal to produce a first magnesium mother alloy.

The producing of the magnesium mother alloy may further include: adding the first magnesium mother alloy to a magnesium molten metal and diluting the magnesium molten metal to form a second magnesium mother alloy.

The producing of the aluminum mother alloy may include: adding at least one kind of second compound in which at least two components are bonded to an aluminum molten metal; exhausting at least a portion of the second compound; and casting the aluminum molten metal to produce a first aluminum mother alloy.

The producing of the aluminum mother alloy may further include: adding the first aluminum mother alloy to an aluminum molten metal and diluting the aluminum molten metal to form a second aluminum mother alloy.

The second compound may be dispersively added to a surface of an upper layer portion of the magnesium molten metal, and the upper layer portion of the magnesium molten metal may be stirred. The stirring may be performed in the upper layer portion from a surface of the magnesium molten metal to a point which is not more than 20% of a total depth of the magnesium molten metal.

The producing of the mother alloy may include: adding calcium or strontium to a mother alloy molten metal; and exhausting at least a portion of the calcium or strontium in the magnesium molten metal.

The aluminum mother alloy may be produced by adding a magnesium alloy in an aluminum molten metal, and the magnesium alloy is produced by a process including: adding calcium or strontium to a magnesium molten metal; and melting at least a portion of the calcium or strontium in the magnesium molten metal.

The aluminum mother alloy may be produced by adding an aluminum alloy in an aluminum molten metal, and the aluminum alloy is produced by a process including: adding calcium or strontium to an aluminum molten metal; and melting at least a portion of the calcium or strontium in the aluminum molten metal.

The magnesium mother alloy may be produced by adding an aluminum alloy in a magnesium molten metal, and the aluminum alloy is produced by a process including: adding calcium or strontium to an aluminum molten metal; and melting at least a portion of the calcium or strontium in the aluminum molten metal.

The magnesium mother alloy may be produced by adding a magnesium alloy in a magnesium molten metal, and the magnesium alloy is produced by a process including: adding calcium or strontium to a magnesium molten metal; and melting at least a portion of the calcium or strontium in the magnesium molten metal.

The producing of the aluminum mother alloy may include adding a magnesium alloy containing the first compound to the aluminum molten metal. The producing of the magnesium alloy containing the first compound may include adding a second compound in a magnesium molten metal, and casting the magnesium molten metal.

In accordance with another exemplary embodiment, an alloy includes a metal matrix, and a first compound existing in the metal matrix. The first compound may be a compound which is included in a magnesium mother alloy or aluminum mother alloy and is added to a molten metal produced so as to cast the alloy.

The metal matrix may include any one selected from the group consisting of tin, aluminum, zinc, magnesium, copper, nickel, cobalt, iron, titanium, vanadium, molybdenum, tungsten, and alloys thereof.

The first compound may include a magnesium compound, an aluminum compound, or a calcium-silicon compound.

The alloy may include an inclusion at a concentration which is lower than that of an inclusion of an alloy in which a mother alloy no containing the first compound is added and which is produced under the same condition.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Hereinafter, the present invention will be described in detail by explaining preferred embodiments of the invention with reference to the attached drawings. The present disclosure may, however, be embodied in many different forms and should not be construed as being limited to the embodiments set forth herein; rather, these embodiments are provided so that this disclosure will be thorough and complete, and will fully convey the concept of the invention to those skilled in the art. Further, the present invention is only defined by scopes of claims.

According to an exemplary embodiment, a mother alloy including at least one kind of compound is produced, and then is added in a molten metal to produce an alloy. At this time, the compound included in the mother alloy is called a 'first compound'.

Figure 1:
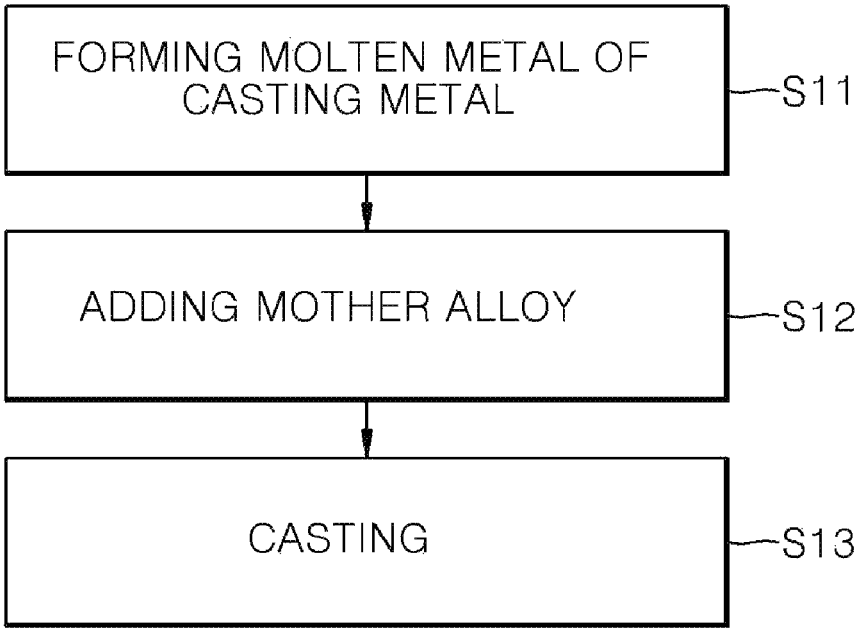
FIG. 1 is a flow diagram showing an embodiment of a method of producing an alloy according to the present disclosure.

FIG. 1 is a flow diagram of a method of producing an alloy according to an exemplary embodiment. Referring to FIG. 1, a molten metal in which a casting metal is melted is formed (S11). The casting metal is a metal that may be added to a mother alloy, and may be any selected from the group consisting of tin (Sn), zinc (Zn), magnesium (Mg), aluminum (Al), copper (Cu), nickel (Ni), cobalt (Co), iron (Fe), titanium (Ti), vanadium (V), molybdenum (Mo), and tungsten (W), or an alloy thereof.

Next, a mother alloy including a first compound is added to the molten metal of the casting metal (S12). Next, a molten metal in which the mother alloy and the casting metal are melted is cast to produce an alloy (S13).

In addition to the method of producing the alloy in which the mother alloy is added in the molten metal of the casting metal as shown in FIG. 1, the alloy may be produced by a method in which the mother alloy and the casting metal are installed together in a melting furnace and then melted at the same time. This is equally applied to the adding of a method of producing a mother alloy to be described later.

Here, the mold may be any selected from the group consisting of a metal mold, a ceramic mold, a graphite mold, and equivalents. Also, examples of the casting may include a sand casting, a die casting, a gravity casting, a continuous casting, a low pressure casting, a squeeze casting, a lost wax casting, a thixo casting, and the like.

In an exemplary embodiment, the mother alloy may use pure magnesium or a magnesium alloy as a mother material, and the pure magnesium and the magnesium alloy are all called a magnesium mother alloy. Alternatively, the mother alloy may use pure aluminum or an aluminum alloy as a mother material, and the pure aluminum and the aluminum alloy are called an aluminum mother alloy. Also, the magnesium molten metal is defined for convenience as indicating pure magnesium molten metal or a magnesium alloy molten metal in which a different alloy element is added in the pure magnesium molten metal, and this definition is equally applied to the aluminum molten metal. Also, the magnesium mother alloy molten metal and the aluminum mother alloy molten metal may be commonly called a mother alloy molten metal.

At this time, at least one kind of first compound included in the mother alloy may be one which is formed by adding a second compound in which at least two components are bonded in the magnesium molten metal and then exhausting at least a portion of the second compound. Hereinafter, a method of producing a magnesium mother alloy including a first compound will be described in detail.

Figure 2:
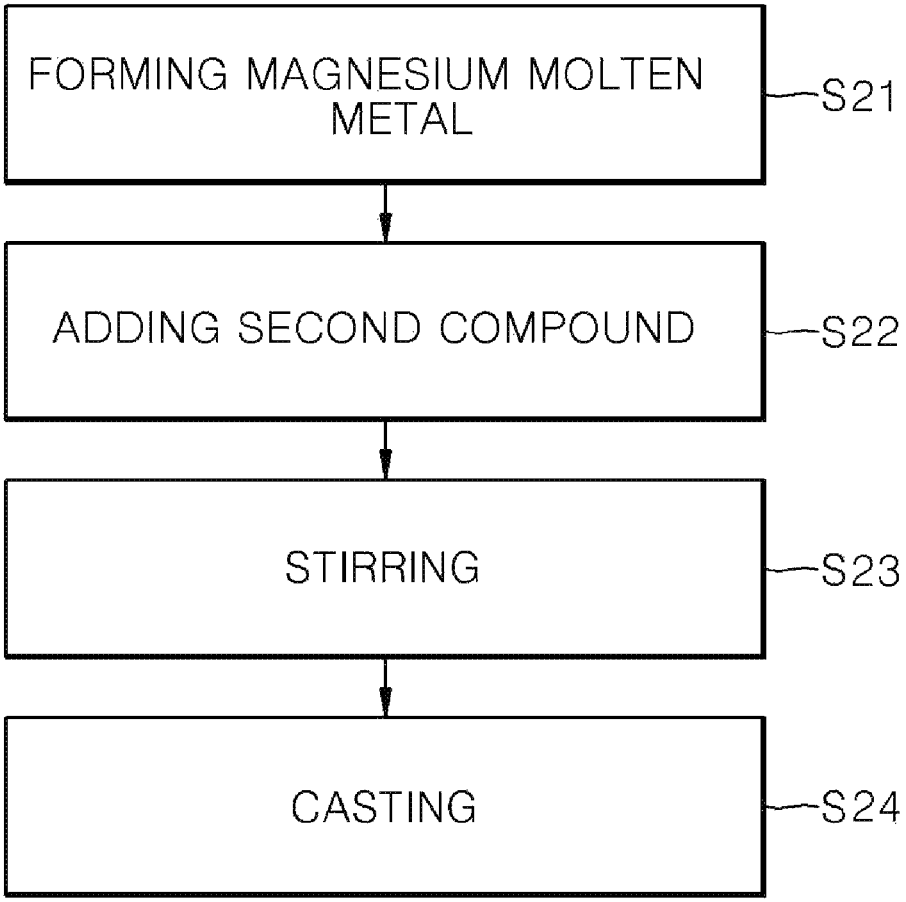
FIG. 2 is a flow diagram showing an embodiment of a method of producing a magnesium mother alloy according to the present disclosure.

FIG. 2 is a flow diagram showing an exemplary embodiment of a method of producing a magnesium mother alloy. Referring to FIG. 2, the method of producing a magnesium mother alloy includes forming a magnesium molten metal (S21), adding a second compound (S22), stirring (S23), and casting (S24).

In the forming (S21) of the magnesium molten metal, pure magnesium or a magnesium alloy is put in a crucible and heated to form a magnesium molten metal. Here, the heating temperature may be in a range of 400° C. to 800° C.

Although in the case of pure magnesium, a molten metal is formed at 600° C. or higher, in the case of the magnesium alloy, a molten metal may be formed at a temperature not higher than 600° C. and not lower than 400° C. due to a melting point drop that may appear by alloying.

Here, when the heating temperature is less than 400° C., it is difficult to foul' a magnesium molten metal, and when the heating temperature exceeds 800° C., sublimation in the magnesium molten metal occurs or there is a danger of ignition.

The magnesium alloy used in the forming (S21) of the magnesium molten metal may be any one selected from the group consisting of AZ91D, AM20, AM30, AM50, AM60, AZ31, AS141, AS131, AS121X, AE42, AE44, AX51, AX52, AJ50X, AJ52X, AJ62X, MRI153, MRI230, AM-HP2, Mg—Al, Mg—Al—Re, Mg—Al—Sn, Mg—Zn—Sn, Mg—Si, Mg—Zn—Y, and equivalents thereof, but the present disclosure is not limited thereto. Any magnesium alloy may be used if it is generally used in industry fields.

Meanwhile, in order to prevent the magnesium molten metal from igniting, a small amount of protection gas may be provided to the magnesium molten metal. The protection gas includes $SF_6$, $SO_2$, $CO_2$, HFC-134a, Novec™612, inert gases and equivalents thereof, and mixture gases thereof, and may suppress ignition of the molten metal.

Next, in the adding (S22) of the second compound, a second compound is added to the magnesium molten metal. At this time, the second compound may be a compound in which two or more components are bonded, and is partly or completely exhausted in the magnesium molten metal. As a result of exhausting, a first compound in which a portion of components constituting the second compound, and a metal component in the magnesium molten metal are bonded may be formed.

Alternatively, in the case where at least two kinds of different second compounds are added, while the second compounds are exhausted, a first compound in which components supplied from each of the second compounds are bonded may be formed.

That is, after being added to the magnesium molten metal, the second compound performs a role as a supply source supplying a component constituting the first compound.

At this time, the second compound may be a calcium-based compound, and may include any one of, for example, calcium oxide (CaO), calcium cyanide ($CaCN_2$), and calcium carbide ($CaC_2$).

While such a calcium-based compound or strontium-based compound is exhausted in the magnesium molten metal, a metal component of the alkali earth metal group and a non-metal component bonded thereto may be decomposed from each other. Thus, a metal component supplied from the alkali earth metal-based compound may be bonded to magnesium that is a metal component in the magnesium molten metal to form a magnesium compound.

Such a magnesium compound may be any one of a magnesium-calcium compound, a magnesium-strontium compound, and a magnesium-aluminum-calcium compound. For example, calcium (Ca) decomposed from calcium oxide may be bonded to magnesium to form a magnesium-calcium compound such as $Mg_2Ca$ and the like, and strontium (Sr) decomposed from strontium oxide may form a magnesium-strontium compound, such as $Mg_2Sr$, $Mg_{23}Sr_6$, $Mg_{38}Sr_9$, $Mg_{17}Sr_2$, etc.

In another example, aluminum may be melted as metal component other than magnesium in the magnesium molten metal, and the aluminum may be bonded to an alkali earth metal element to form an aluminum compound. The aluminum compound may include at least one of an aluminum-calcium compound and an aluminum-strontium compound. For example, calcium decomposed from calcium oxide may be boned to aluminum to form an aluminum-calcium compound, such as $Al_2Ca$, $Al_4Ca$, or the like, and strontium (Sr) decomposed from strontium oxide may be bonded to aluminum to form an aluminum-strontium compound such as $Al_4Sr$, or the like.

According to circumstances, the magnesium component and the aluminum component in the magnesium molten metal may be bonded together to form a composite oxide such as $(Mg,Al)_2Ca$, or the like.

Another example of the second compound may be a silicon-based compound. The silicon-based compound may include, for example, silicon oxide ($SiO_2$), and the like. Like the above description, silicon (Si) decomposed from silicon oxide may be boned to a magnesium component to form a magnesium-silicon compound, such as $Mg_2Si$, or the like.

In another example, the second compound may be a rare earth compound, and may include, for example, scandium oxide ($Sc_2O_3$), cesium oxide ($CeO_2$), and the like. Like the above description, a rare earth metal supplied from the rare earth compound may bond to magnesium or aluminum. For example, cesium (Cs) may be boned to aluminum to form an aluminum-cesium compound, such as $Al_2Ce$ or the like, and scandium (Sc) may be boned to aluminum to form an aluminum-scandium compound, such as $Al_2Sc$.

The second compound may be added in at least two portions that are different in kind from each other. For example, calcium oxide and silicon oxide may be added in the magnesium molten metal at the same time. At this time, calcium supplied from calcium oxide and silicon supplied from silicon oxide may be bonded to each other in the magnesium molten metal to form a calcium-silicon compound, such as CaSi, or the like.

Meanwhile, oxidation resistance of the magnesium molten metal can be improved by the second compound added to the magnesium molten metal. For example, when a calcium-based compound is added to the magnesium molten metal, oxidation resistance of the magnesium molten metal is improved and thus ignition resistance is increased, so that introduction of oxide or other inclusions into the magnesium molten metal is suppressed. Therefore, the amount of the protection gas necessary for melting magnesium can be remarkably reduced or may not be used at all.

The first compound included in the magnesium mother alloy may have a higher melting point than a casting metal. For example, $Mg_2Si$, $Al_2Ca$, $Al_4Sr$, $Al_2Sc$, and $Al_2Se$ have melting points of 1085° C., 1078° C., 1040° C., 1420° C., and 1480° C., respectively, and casting metals, for example, tin, zinc, magnesium, and aluminum have melting points of 231.9° C., 419.5° C., 649° C., and 660.1° C., respectively.

Therefore, in the case where a magnesium mother alloy including the first compound having a higher melting point than such casting metals is added as an alloy element to the molten metal of the casting metal, the first compound may be distributed in the matrix of the casting metal after cast. That is, since the molten metal of the casting metal is maintained in liquid phase at a lower temperature than the melting point of the first compound, the first compound added together with the magnesium mother alloy is not melted in the molten metal of the casting metal but exists in solid phase, and after cast and solidified, is distributed on the matrix of the casting metal.

Therefore, by adding a mother alloy containing the first compound having a higher melting point than the casting metal, a compound can be formed on the matrix of the metal without a separate treatment, such as a heat treatment or a mechanical processing.

For example, aluminum alloy 6063 that is a commercial alloy allows a large amount of $Mg_2Si$ to be distributed on an aluminum matrix, thus greatly improving the mechanical strength. To form $Mg_2Si$, magnesium and silicon are added to aluminum and a heat treatment is performed to precipitate $Mg_2Si$ on the aluminum matrix.

Compared to this, according to an exemplary embodiment, an aluminum mother alloy containing $Mg_2Si$ as the first compound may be added to an aluminum molten metal and then cast to easily produce an aluminum alloy in which $Mg_2Si$ is formed in the aluminum matrix.

Among components of the second compound added to the magnesium molten metal, a remaining component that is not bonded to a metal component within the molten metal is discharged in the state of gas to the atmosphere through a portion over the surface of the magnesium molten metal or may be floated on the molten metal in the form of dross or sludge.

The second compound is advantageous for enhancement of reactivity when the surface area thereof is as wide as possible, and thus is added in the form of powder. However, the present disclosure is not limited thereto, and the silicon-based additive may be added in the form of pellet or bulk in which powder particles are agglomerated so as to prevent powder from scattering.

The size of the second compound may be in a range of 0.1 μm to 500 μm, and more strictly in a range of 0.1 μm to 200 μm.

When the size of the second compound is less than 0.1 μm, the size is so fine that the second compound is scattered by sublimated magnesium or hot wind and thus have a difficulty in introducing the same in the crucible. Also, since the second compounds are agglomerated to form an agglomerate, they are not easily mixed with the liquid phase molten metal. Such an agglomerate is not preferred in that it decreases the surface area for reaction.

When the size of the second compound exceeds 500 μm, the surface area for a reaction decreases, and further the second compound may not react with the magnesium molten metal.

The second compound may be added in a range of 0.001 wt % to 30 wt %, and more strictly, in a range of 0.01 wt % to 15 wt %. When the total added amount of the second compound is less than 0.001 wt %, an effect by addition of the second compound is slight or is almost not generated. Also, when the total added amount of the second compound exceeds 30 wt %, the fluidity of the molten metal may be degraded.

The second compounds may be added to the molten metal at the same time, or with a time difference. The second compound may be added at one time by a necessary amount, or may be added in multi-stage with a constant time difference by dividing the necessary amount into proper amounts. When the added second compound is a powder having fine particles, the agglomeration possibility of the powder may be lowered and the reaction of the second compound may be promoted by adding the second compound in multi-stage with a constant time difference.

Figure 3:
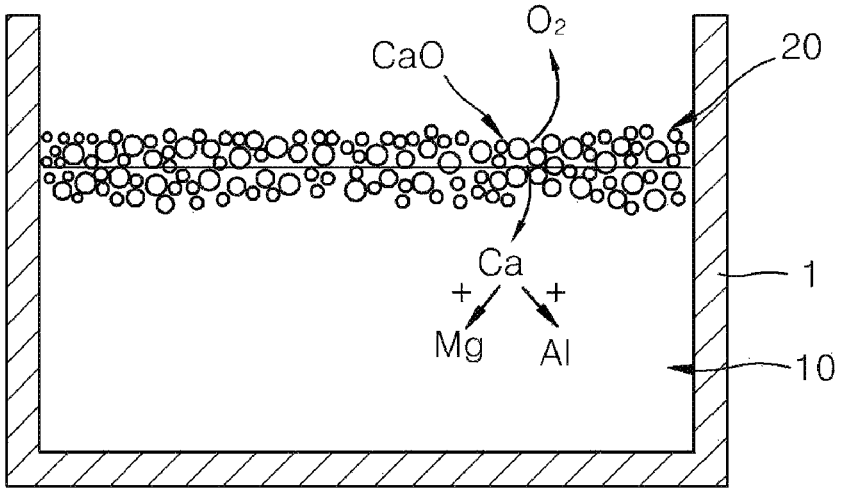
FIG. 3 is a schematic view showing a decomposition process of calcium oxide in an upper layer portion of a magnesium molten metal when calcium oxide is added in the magnesium molten metal.

To promote decomposition and reaction of the second compound, the second compound may be dispersively added to a surface of an upper layer portion of the molten metal. FIG. 3 is a schematic view exemplarily illustrating a decomposition process of calcium oxide 20 in an upper layer portion of a magnesium molten metal 10 when calcium oxide 20 is added to the magnesium molten metal 10 in a melting furnace 1. Referring to FIG. 3, calcium oxide 20 is decomposed into oxygen ($O_2$) and calcium (Ca) in the upper layer portion of the magnesium molten metal 10. The decomposed oxygen is a gas ($O_2$), is discharged to the outside from the melting furnace or is floated on the magnesium molten metal in the form of dross or sludge. Meanwhile, the decomposed calcium may react with another element, for example, magnesium (Mg) or aluminum (Al) in the molten metal to form various compounds.

Therefore, it is important in this embodiment to create a reaction environment such that the second compound is not introduced into the magnesium molten metal but reacts with an element in the surface of the molten metal. For this, the added second compound may be maintained such that it stays on the surface of the molten metal for a long time and is exposed to the atmosphere.

In order to more promote the decomposition and reaction of the added second compound, stirring (S3) of the magnesium molten metal may be performed. The stirring may start at the same time with the adding of the second compound or after the added second compound is heated to a predetermined temperature in the molten metal.

In the case of a typical metal alloying, the molten metal and an alloy element are positively stirred such that a reaction occurs in the molten metal through convection or stirring. However, when a positive reaction of the second compound is induced in this embodiment, the reaction of the second compound is not effective and thus the frequency that the second compound remains in the final molten metal in a non-decomposed state increases. In the case where the second compound remains in the final molten metal, the remaining second compound may be incorporated into the cast magnesium alloy to degrade the mechanical characteristics of the magnesium alloy.

Table 1 shows a measurement result of the amount of calcium oxide remaining according to a stirring method when calcium oxide (CaO) is added to AM60B molten metal. The size of the added calcium oxide is 70 μm, and the calcium oxide is added by 5 wt %, 10 wt %, and 15 wt %. Stirring of an upper layer portion of the magnesium molten metal, inner stirring, and no stirring are selected as a way for confirming a stirring effect. It can be known from Table 1 that when the stirring of the upper layer portion of the magnesium molten metal is performed, most of the added calcium oxide is reduced into calcium, unlike other cases.

TABLE 1

| | | Adding of 5 wt % of CaO | Adding of 10 wt % of CaO | Adding 15 wt % of CaO |
|---|---|---|---|---|
| Remaining amount of CaO in alloy | No stirring | 4.5 wt % of CaO | 8.7 wt % of CaO | 13.5 wt % of CaO |
| | Stirring in molten metal | 1.2 wt % of CaO | 3.1 wt % of CaO | 5.8 wt % of CaO |
| | Stirring in upper layer portion of molten metal | 0.001 wt % of CaO | 0.002 wt % of CaO | 0.005 wt % of CaO |

The stirring may be performed in an upper layer portion from the surface of the magnesium molten metal to a point which is not more than 20% of a total depth of the magnesium molten metal, and more strictly, in an upper layer portion to a point which is not more than 10% of the total depth of the magnesium molten metal. At the depth exceeding 20%, decomposition of the second compound in the surface does not easily occur.

The stirring time may be different depending on the temperature of the molten metal and the state of added powder, and the stirring may be sufficiently performed until the added second compound is completely exhausted in the molten metal. The term "exhausting" indicates that the decomposition of the second compound is substantially completed.

Such stirring can more promote the decomposition of the second compound in the magnesium molten metal and a process in which a component supplied by such decomposition reacts with a metal component in the magnesium molten metal to form various first compounds.

When the stirring (S23) of the magnesium molten metal is completed, casting (S24) in which the magnesium molten metal is injected into a mold to solidify the injected molten metal is performed to produce a magnesium mother alloy.

In the adding (S22) of the second compound to the magnesium molten metal, calcium (Ca) or strontium (Sr) element instead of a calcium-based compound or strontium-based compound may be added as the second compound to produce a magnesium mother alloy. In this case, similarly to the second compound, the added calcium or strontium may be melted in the magnesium molten metal to form a first compound.

Figure 4:
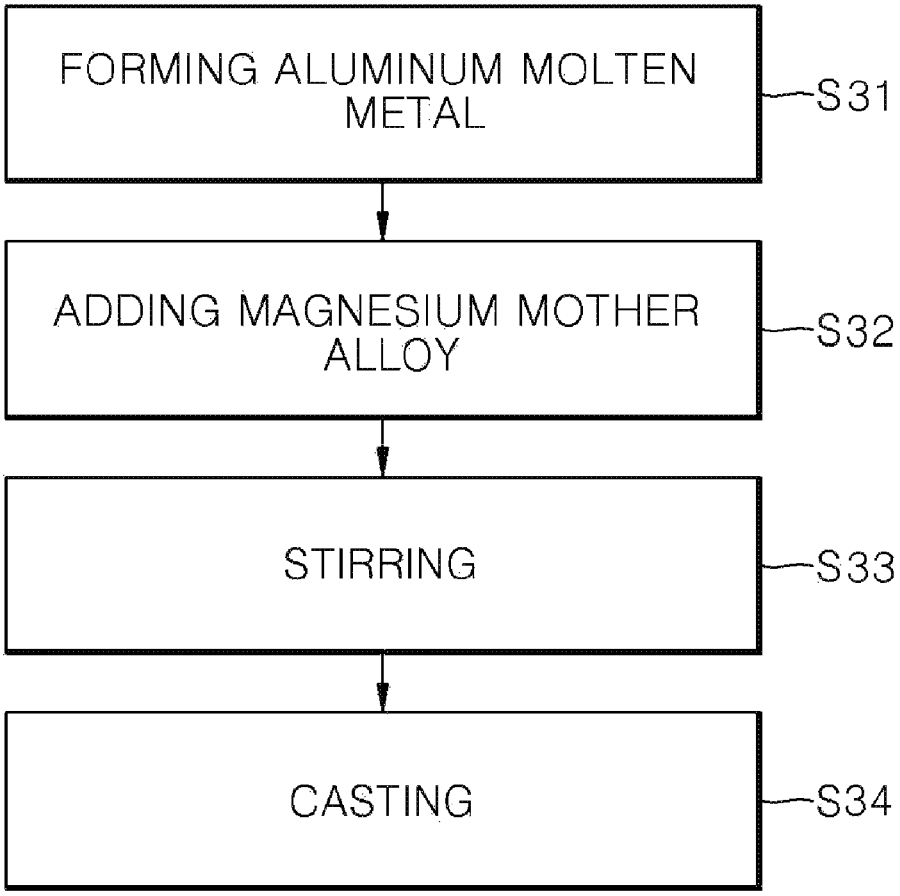
FIG. 4 is a flow diagram showing an embodiment of a method of producing an aluminum mother alloy according to the present disclosure.

As another example of the mother alloy, an aluminum mother alloy may be used. FIG. 4 is a flow diagram showing an exemplary embodiment of a method of producing an aluminum mother alloy. Referring to FIG. 4, the method of producing the aluminum alloy includes forming (S31) of an aluminum molten metal, adding (S32) of a magnesium mother alloy, stirring (S33), and casting (S34).

In the forming (S31) of the aluminum molten metal, aluminum is put in a crucible and then is heated in a temperature range of 600° C. to 900° C. to form an aluminum molten metal.

The aluminum in the forming (S31) of the aluminum molten metal may be any one selected from the group consisting of pure aluminum, an aluminum alloy, and equivalents thereof. The aluminum alloy may be any one selected from the group consisting of 1000 series, 2000 series, 3000 series, 4000 series, 5000 series, 6000 series, 7000 series and 8000 series plastic working aluminum alloys, or 100 series, 200 series, 300 series, 400 series, 500 series, and 700 series casting aluminum alloys.

Next, in the adding (S32) of the magnesium alloy, a magnesium alloy which is produced by the above-described method and includes a first compound is added to the aluminum molten metal.

In the adding (S32) of the magnesium alloy, the magnesium alloy may be added in a range of 0.0001 parts by weight to 30 parts by weight based on 100 parts by weight of aluminum. When the added amount of the magnesium mother alloy is less than 0.0001 parts by weight, an effect according to the adding of the magnesium alloy may be small. Also, when the added amount of the magnesium mother alloy exceeds 30 parts by weight, the original characteristics of the aluminum alloy do not appear.

The magnesium alloy may be added in the form of an ingot, but the present disclosure is not limited thereto, and the magnesium alloy may have other forms such as powder form, granule form, and the like. Also, the size of the magnesium mother alloy is not limited.

In the adding (S32) of the magnesium alloy, the first compound included in the magnesium alloy is also provided to the aluminum molten metal. As described above, the magnesium alloy may have therein the first compound having a higher melting point than aluminum, and when the magnesium mother alloy including the first compound is added to the aluminum molten metal, the first compound may be included in an aluminum alloy.

Next, the aluminum molten metal is stirred for a predetermined time (S33), and then the casting (S34) in which the aluminum molten metal is injected into a mold and is solidified is performed to produce an aluminum alloy.

The produced aluminum alloy may be any one selected from the group consisting of 1000 series, 2000 series, 3000 series, 4000 series, 5000 series, 6000 series, 7000 series and 8000 series plastic working aluminum alloys, or 100 series, 200 series, 300 series, 400 series, 500 series, and 700 series casting aluminum alloys.

Thus, when the magnesium mother alloy or aluminum mother alloy including the first compound is added as an alloy element to the molten metal of the casting metal, oxidation resistance of the molten metal of the casting metal can be improved.

As describe above, the magnesium mother alloy to which a calcium-based compound is added may contain a magnesium-calcium compound, an aluminum-calcium compound, a magnesium-aluminum-calcium compound, and the like as the first compound, and the aluminum mother alloy produced by adding such a mother alloy also contains the first compound described above.

As the oxidation resistance of the magnesium mother alloy or aluminum mother alloy including the first compound greatly increases, the inclusion of impurities such as oxide in the molten metal of the casting metal remarkably decreases, compared to a case in which magnesium or aluminum no containing the first compound is added. Therefore, in the case where the mother alloy according to an exemplary embodiment is added as an alloy element, although a protection gas is not used, cleanness of the molten metal of the casting metal can be greatly enhanced to remarkably improve the quality of the molten metal. Due to the improvement of the quality of the molten metal, the physical properties, such as the mechanical and chemical characteristics of the cast alloy are greatly improved.

In the adding (S32) of the magnesium alloy to the aluminum molten metal, the magnesium mother alloy may be produced by adding calcium (Ca) or strontium (Sr) in the form of element, instead of adding the magnesium alloy including the first compound. While being melted in the aluminum molten metal, such calcium or strontium may react with aluminum to form a first compound, such as $Al_2Ca$, $Al_4Ca$, $Al_4Sr$, or the like.

While all of the above-described methods of producing the mother alloy includes adding a second compound or pure element to a mother alloy molten metal and allowing a reaction to occur in the mother alloy molten metal to form a first compound, the present disclosure is not limited thereto, and in another exemplary embodiment, it will be also possible to directly add the first compound to the mother alloy molten metal. At this time, the first compound may be one produced by various methods in the outside.

For example, aluminum powder and calcium powder are put in an apparatus such as a ball-mill to produce $Al_2Ca$ powder through a mechanical alloying, and the produced $Al_2Ca$ powder may be added as a first compound to the aluminum molten metal. In this case, $Al_2Ca$ is included as the first compound in the cast magnesium alloy or aluminum alloy.

As another example, the $Al_2Ca$ powder produced as above is added to a magnesium molten metal to produce a magnesium alloy containing $Al_2Ca$, and then the produced magnesium alloy may be again added to an aluminum molten metal to produce an aluminum mother alloy containing $Al_2Ca$.

While the mechanical alloying has been suggested as a method for forming the first compound, the present disclosure is not limited thereto, and any method will be allowable if it is a method of capable of forming the first compound.

Meanwhile, the mother alloy including the first compound may be further subject to diluting thereof. For example, the magnesium mother alloy (for convenience, referred to as a first magnesium mother alloy) produced by the above-described method may be added to a magnesium molten metal and diluted to form a second magnesium mother alloy including a first compound having a decreased concentration. Likewise, it is of course that a second aluminum mother alloy may be formed by diluting the first aluminum mother alloy.

Hereinafter, in order to help understanding of the present disclosure, experimental examples are provided. It will be understood that the following experimental examples are not provided to limit the present disclosure but are only provided to help the understanding of the present disclosure.

FIGS. 5A through 5D show analysis results of a magnesium mother alloy according to an exemplary embodiment by electron probe micro analyzer (EPMA), in which the magnesium mother alloy is one produced by adding calcium oxide (CaO) as a second compound to a magnesium alloy containing aluminum as an alloy element.

Figure 5A:
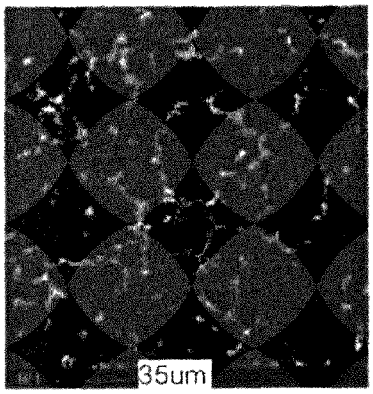
FIG. 5A shows composition analysis results by a back scattering electron probe micro analyzer (EPMA) of a microstructure of a magnesium mother alloy having a plurality of crystal grains.

FIG. 5A shows a microstructure of the magnesium mother alloy observed using a back scattering electron. As shown in FIG. 5A, the magnesium mother alloy shows a microstructure having a plurality of crystal grains surrounded by compounds (white portions). The compounds (white portions) are formed along grain boundaries.

Figure 5B:
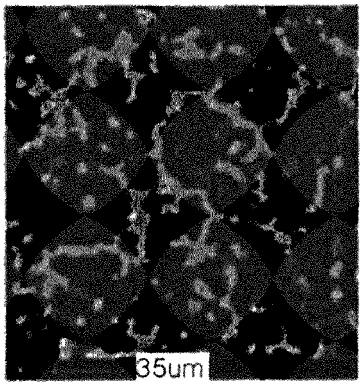
FIG. 5B shows distribution regions of the EPMA mapping results of aluminum in the compound regions of the magnesium mother alloy of FIG. 5A.
Figure 5C:
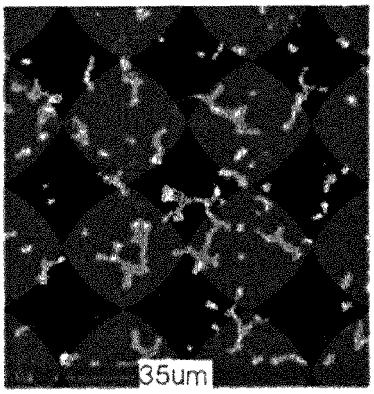
FIG. 5C shows distribution regions of the EPMA mapping results of calcium in the compound regions of the magnesium mother alloy of FIG. 5A.
Figure 5D:
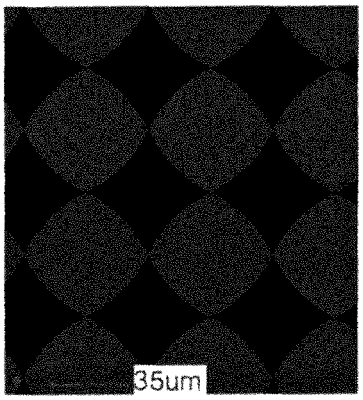
FIG. 5D shows distribution regions of the EPMA mapping results of oxygen in the compound regions of the magnesium mother alloy of FIG. 5A.

FIGS. 5B through 5D show distribution regions of aluminum, calcium, and oxygen that are mapping results of components in the compound regions (white portions) by EPMA. As shown in FIGS. 5B and 5C, aluminum and calcium were detected from the compounds (white portion of FIG. 5A) but oxygen was not detected (FIG. 5D).

From this result, it can be known that an aluminum-calcium compound that is produced as calcium separated from calcium oxide reacts with aluminum included in the mother material is distributed. Such an aluminum-calcium compound may be $Al_2Ca$ or $Al_4Ca$ that is an intermetallic compound.

FIGS. 6A through 6E show EPMA analysis results of an aluminum mother alloy produced according to an exemplary embodiment. Here, the magnesium mother alloy added to the aluminum molten metal was one which is produced by adding calcium oxide to a magnesium molten metal including aluminum.

Figure 6A:
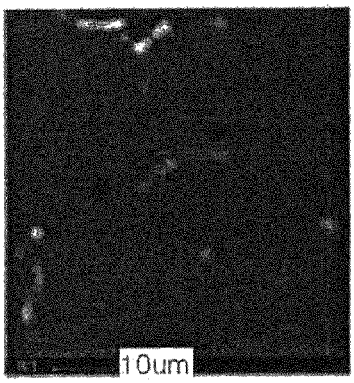
FIG. 6A shows electron probe micro analyzer (EPMA) analysis results of a microstructure of an aluminum mother alloy.
Figure 6B:
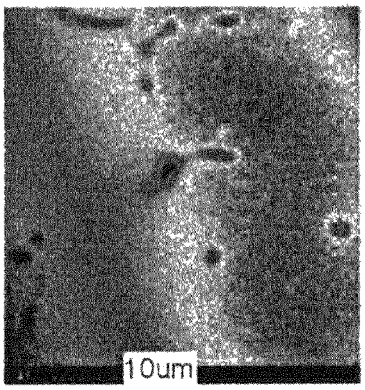
FIG. 6B shows the EPMA mapping results of aluminum in the aluminum mother alloy of FIG. 6A.
Figure 6C:
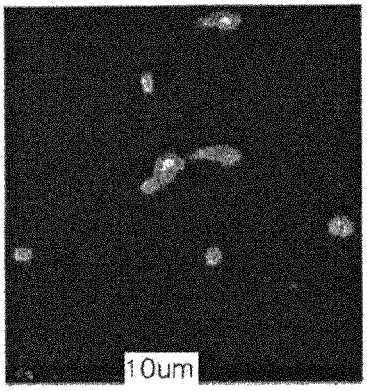
FIG. 6C shows the EPMA mapping results of calcium in the aluminum mother alloy of FIG. 6A.
Figure 6D:
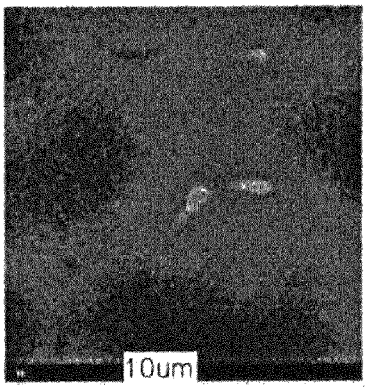
FIG. 6D shows the EPMA mapping results of magnesium in the aluminum mother alloy of FIG. 6A.
Figure 6E:
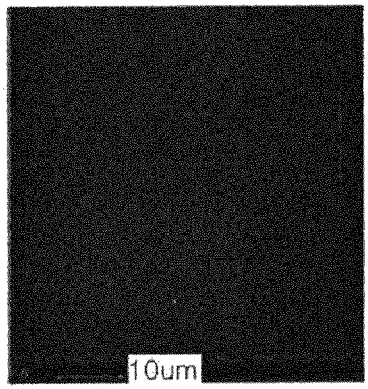
FIG. 6E shows the EPMA mapping results of oxygen in the aluminum mother alloy of FIG. 6A.

FIG. 6A shows a microstructure of an aluminum mother alloy observed by EPMA, and FIG. 6B through 6E show mapping results of aluminum, calcium, magnesium, and oxygen that are mapping results of components by EPMA. As seen from FIGS. 6B through 6D, calcium and magnesium were detected at the same locations of the aluminum matrix, but oxygen was not detected as shown in FIG. 6E. From this result, it can be known that the magnesium-aluminum-calcium compound which is included as the first compound in the magnesium mother alloy also exists as the first compound in the aluminum mother alloy.

Figure 7A:
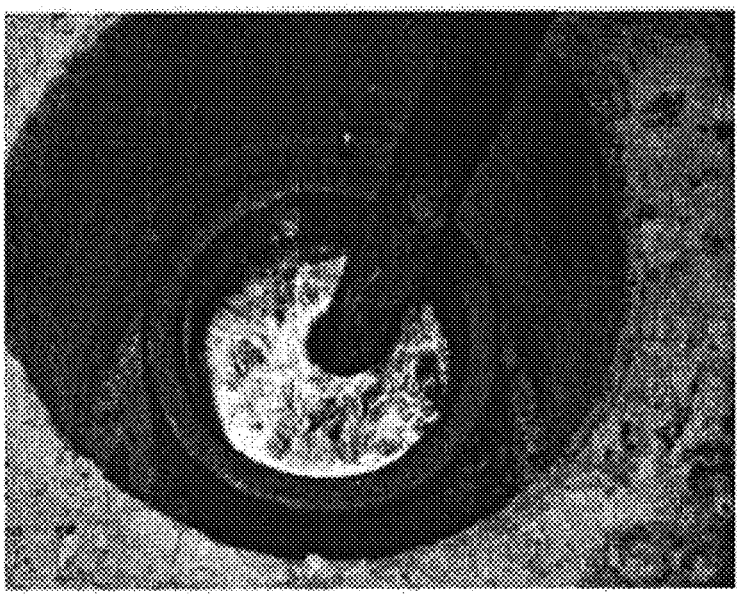
FIG. 7A shows a state of an aluminum molten metal in which a magnesium mother alloy produced by an embodiment of the present disclosure is added.
Figure 7B:
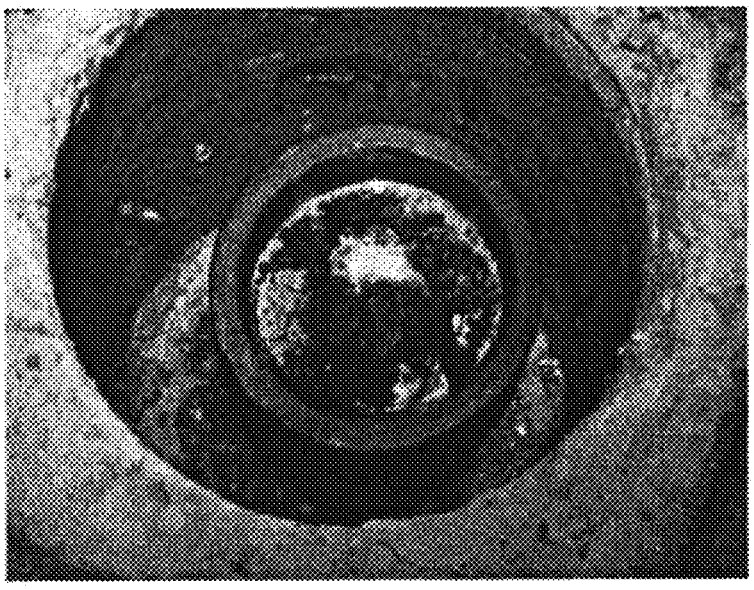
FIG. 7B shows a state of aluminum molten metal which is produced by adding pure magnesium.

Meanwhile, FIG. 7A shows a state of an aluminum molten metal which is produced by adding a magnesium mother alloy, and FIG. 7B shows a state of an aluminum molten metal which is produced by adding pure magnesium. Referring to FIGS. 7A and 7B, it can be known that in the case the magnesium mother alloy is added, although a protection gas is not used, the state of the molten metal is good, whereas in the case pure aluminum is added, the surface of the molten metal is changed to black color due to oxidation of magnesium. From this result, it can be confirmed that when the magnesium mother alloy produced according to an exemplary embodiment is added, the oxidation resistance of the molten metal is remarkably increased.

Table 2 shows results obtained by observing and comparing states of a magnesium molten metal according to the added amount of protection gas, $SF_6$ in a case where beryllium (Be) is added in a magnesium molten metal and in a case where calcium oxide is added. Here, the magnesium molten metal was produced from a magnesium-aluminum alloy (Mg-0.45Al) in which 0.45 wt % of aluminum is added.

TABLE 2

| | Added amount of Be (wt %) | | | | Added amount of CaO (wt %) | | | |
|---|---|---|---|---|---|---|---|---|
| $SF_6$ (%) | 0 | 5 | 10 | 20 | 0.01 | 0.05 | 0.1 | 0.3 |
| 0 ($CO_2$ 100%) | XX | X | X | X | X | X | ○ | □ |
| 0.05 | X | X | X | □ | □ | ○ | □ | □ |
| 0.1 | X | □ | □ | ○ | ○ | ○ | □ | □ |
| 0.2 | □ | ○ | ○ | ○ | ○ | □ | □ | □ |
| 0.5 | ○ | ○ | ○ | ○ | □ | □ | □ | □ |

□: Very good,
○: Good,
□: Normal,
X: Bad,
XX: Very bad

In the case Be was added by 20 wt % but $SF_6$ gas was not added, a bad state such as ignition of the magnesium molten metal was observed, whereas in the case where calcium oxide was added by 0.1 wt % or more, a good state of the magnesium molten metal was observed. When the added amounts of $SF_6$ gas were equal, the case where calcium oxide was added in an amount which is smaller than that of beryllium shows more superior state of the molten metal. From this result, it can be known that the case calcium oxide is added is more superior than the case beryllium is added.

Figure 8:
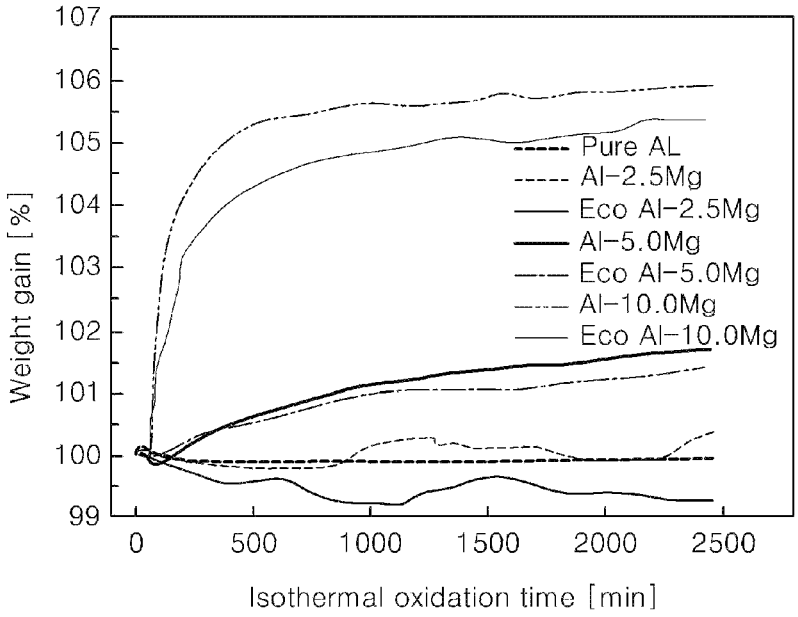
FIG. 8 is a graph showing oxidation resistance test results of an aluminum alloy according to an embodiment of the present disclosure.

FIG. 8 shows an oxidation resistance measurement result according to the amount of calcium oxide in the magnesium mother alloy. The oxidation of the magnesium mother alloy was performed in an oxygen atmosphere at 550° C. for 40 hours. Referring to FIG. 8, it can be seen that as the amount of calcium oxide increases, oxidation resistance is remarkably improved.

Figure 9:
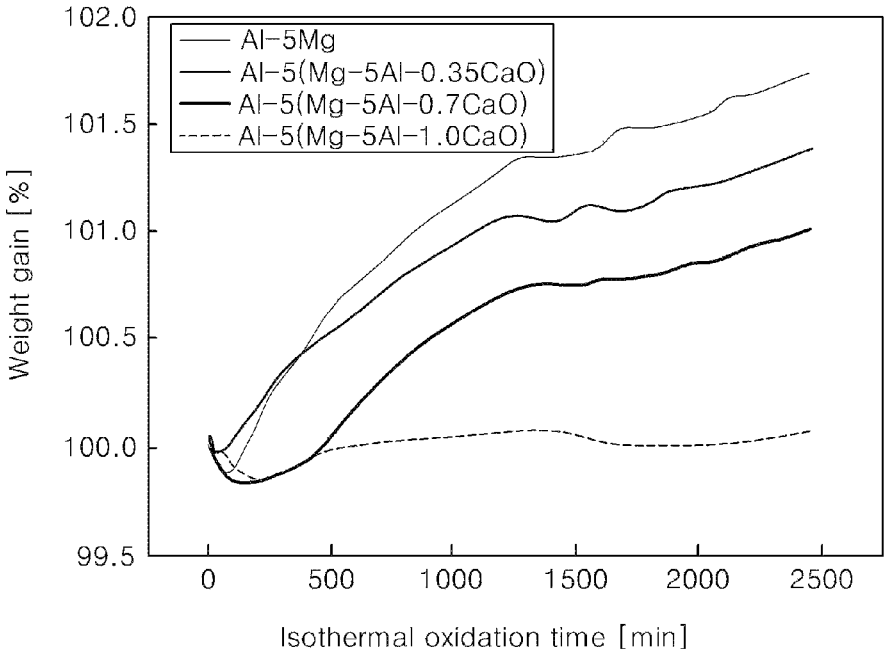
FIG. 9 is a graph showing comparison results of oxidation resistance of a related art aluminum-magnesium alloy having the same composition as an aluminum-magnesium alloy according to an embodiment of the present disclosure.

FIG. 9 is a graph for comparison of oxidation resistance in an aluminum alloy produced according to an exemplary embodiment and an aluminum alloy produced by a method different from an exemplary embodiment, both having the same magnesium composition. In the graph of FIG. 9, x-axis represents isothermal oxidation time (minute), and y-axis represents weight gain (%), respectively. Also, red line, green line, and blue line represent 2.5 wt %, 5 wt %, and 10 wt % of aluminum alloys, respectively, and dotted line having the same color indicates an aluminum alloy which has the same magnesium composition, and is produced from a magnesium mother alloy produced by adding calcium oxide as a second compound. Referring to FIG. 9, it can be known that the aluminum alloys according to an exemplary embodiment have superior oxidation resistance.

By the production methods according to embodiments of the present disclosure, although an alloy element having a high oxidation property, such as magnesium or aluminum is added in a molten metal, cleanness of the molten metal can be maintained at a high level, and thus characteristics of the cast alloy can be remarkably improved. Also, by adding a mother alloy including a compound as an alloy element, the compound can be formed in the matrix of the alloy without a separate treatment. The effects of the present disclosure are not limited to the above descriptions, and other effects that are not mentioned will be apparently understood to those skilled in the art from the following descriptions.

The descriptions for the specific embodiments of the present disclosure are provided for the purpose of illustration and explanation. Therefore, it will be understood by those of ordinary skill in the art that various modifications and changes, such as combinations of the embodiments may be made therein without departing from the technical spirits and scope of the present invention.

The invention claimed is:

1. A method of producing an alloy, comprising:

forming an aluminum mother alloy including an aluminum and a first compound; and forming a molten metal in which the aluminum mother alloy and a casting metal are melted; and casting the molten metal;

wherein the casting metal is any one selected from the group consisting of tin, aluminum, zinc, magnesium, copper, nickel, cobalt, iron, titanium, vanadium, molybdenum, tungsten, and alloys thereof, wherein the forming of the aluminum mother alloy comprises:

adding at least one kind of a second compound in a range of 0.001 wt % to 30 wt % in an aluminum molten metal;

forming the first compound by exhausting at least a portion of the second compound in the aluminum molten metal;

forming the aluminum mother alloy by casting the aluminum molten metal, wherein the first compound comprises at least one selected from the group consisting of $Al_2Ca$, $Al_4Ca$, $Al_4Sr$, $Al_2Sc$, $Al_2Ce$, and CaSi, wherein the second compound comprises at least one selected from the group consisting of calcium oxide (CaO), calcium cyanide ($CaCN_2$), and calcium carbide ($CaC_2$), strontium oxide (SrO), silicon oxide ($SiO_2$), scandium oxide ($Sc_2O_3$) and cesium oxide ($CeO_2$).

2. The method of claim 1, wherein the first compound has a higher melting point than the casting metal.

3. The method of claim 1, wherein the first compound is formed by completely exhausting the second compound in the aluminum molten metal.

4. The method of claim 1, wherein the first compound is a compound in which a component supplied from the exhausted second compound and a metal component in the aluminum molten metal are bonded to each other.

5. The method of claim 1, wherein the first compound is a compound produced by a bonding between components respectively supplied from the exhausted at least two kinds of second compounds.

6. The method of claim 1, wherein the second compound is dispersively added to a surface of an upper layer portion of the aluminum molten metal.

7. The method of claim 1, wherein the upper layer portion of the aluminum molten metal is stirred to exhaust the second compound.

8. The method of claim 7, wherein the stirring is performed in the upper layer portion from the surface of the aluminum molten metal to a point which is not more than 20% of a total depth of the aluminum molten metal.

9. The method of claim 1, wherein any one component of the second compound is removed upward from a surface of the aluminum molten metal.

* * * * *